US012025122B2

(12) United States Patent
King

(10) Patent No.: US 12,025,122 B2
(45) Date of Patent: Jul. 2, 2024

(54) CARBON FREE COMPRESSOR PUMP SYSTEM

(71) Applicant: King Power Company, LLC, Ooltewah, TN (US)

(72) Inventor: Forrest A King, Ooltewah, TN (US)

(73) Assignee: KING POWER COMPANY, LLC, Ooltewah, TN (US)

( * ) Notice: Subject to any disclaimer, the term of this patent is extended or adjusted under 35 U.S.C. 154(b) by 82 days.

(21) Appl. No.: 17/876,372

(22) Filed: Jul. 28, 2022

(65) Prior Publication Data

US 2023/0032921 A1 Feb. 2, 2023

Related U.S. Application Data

(60) Provisional application No. 63/226,608, filed on Jul. 28, 2021.

(51) Int. Cl.

| | |
|---|---|
| ***F04B 9/06*** | (2006.01) |
| ***F04B 17/03*** | (2006.01) |
| ***F04B 27/08*** | (2006.01) |
| ***F04B 27/10*** | (2006.01) |
| ***F04B 35/01*** | (2006.01) |
| ***F04B 35/04*** | (2006.01) |
| ***F04B 53/16*** | (2006.01) |

(52) U.S. Cl.

CPC ..... *F04B 9/06* (2013.01); *F04B 17/03* (2013.01); *F04B 27/0878* (2013.01); *F04B 27/0891* (2013.01); *F04B 27/0895* (2013.01); *F04B 27/1045* (2013.01); *F04B 35/01* (2013.01); *F04B 35/04* (2013.01); *F04B 53/16* (2013.01)

(58) Field of Classification Search

CPC ..... F04B 7/04; F04B 9/02; F04B 9/06; F04B 17/03; F04B 27/0873; F04B 27/0891; F04B 27/0895; F04B 27/1045; F04B 35/01; F04B 35/04; F04B 39/0005; F04B 39/0022; F04B 39/0055; F04B 53/14; F04B 53/143; F04B 53/146; F04B 53/148; F04B 53/16

See application file for complete search history.

(56) References Cited

U.S. PATENT DOCUMENTS

| | | | | |
|---|---|---|---|---|
| 722,240 | A * | 3/1903 | Millspaugh | F04B 1/02 92/147 |
| 1,498,471 | A * | 6/1924 | Miller | F04B 9/06 417/259 |

(Continued)

*Primary Examiner* — Devon C Kramer
*Assistant Examiner* — Joseph S. Herrmann

(57) ABSTRACT

The carbon free compressor pump system is a device that utilizes several pistons in a hydraulic or power press manner to compress gas or pump fluids. The device utilizes mechanical advantage of a pulley on the upstroke and uses a clutch device to utilize the gravitational force on the downstroke. In order to accomplish this the device includes a base that allows the compression process to take place and ensure there is only vertical movement. Further, the weight block ensures the system can utilize gravitational force on the downstroke. Further, the plurality of outtakes allows for the gas or fluids to flow out of the system once compressed or pumped. Furthermore, the conical tank takes the compressed gas or pumped fluid and further compresses the gas, increasing the pressure without moving parts. Thus, the device operates on carbon free electricity to compress gas and pump fluids.

19 Claims, 10 Drawing Sheets

(56) References Cited

U.S. PATENT DOCUMENTS

| | | | | | |
|---|---|---|---|---|---|
| 3,632,234 | A * | 1/1972 | Lake | F04B 9/105 | 417/399 |
| 3,659,786 | A * | 5/1972 | Vier | F23G 7/001 | 239/11 |
| 4,669,364 | A * | 6/1987 | Komatsu | B62D 5/22 | 92/255 |
| 5,647,208 | A * | 7/1997 | Spitzbarth | F04B 47/04 | 60/446 |
| 6,655,935 | B2 * | 12/2003 | Bennitt | F04B 39/102 | 417/523 |
| 7,402,028 | B2 * | 7/2008 | Wong | F04B 9/02 | 417/328 |

* cited by examiner

CARBON FREE COMPRESSOR PUMP SYSTEM

FIELD OF THE INVENTION

The present invention relates generally to a compressor or pump system that can compress gas or pump fluids. More specifically, the present invention is a device that utilizes the power of multiple pistons in a hydraulic or power press manner to compress both gas and pump liquids.

BACKGROUND OF THE INVENTION

Natural gas pipelines have utilized large gas fired compressors and electric powered conventional electric compressors for many years. Unfortunately, both of these methods for gas compression have several drawbacks that limit the efficiency of the entire system. Rotary natural gas fired compressors create large amounts of waste heat and create large amounts of $CO_2$ making the system extremely inefficient. The same style rotary pumps for pumping water usually come with the same problems and issues. Many individuals opted to use compressors and pumps that are powered by electricity to eliminate some of the inefficiencies. However, many of these compressors and pumps that are powered by electricity, still work on fossil fuels to generate power, thus still producing $CO_2$.

An objective of the present invention is to provide users with a compressor pump system that can be used as a power press as well as an engine, to compress gas and pump fluids. The present invention intends to provide users with a device that can be fully powered by electricity that is generated by a device, where the electricity produced is carbon free and is produced adjacent to the compressor pump system. The present invention is a compressor pump system that utilizes several pistons in a hydraulic or power press manner to compress gas or pump fluids. In order to accomplish that, a preferred embodiment of the present invention comprises a base, a weight block, a pulley system, a plurality of intakes, a plurality of outtakes, and a conical tank. Further, the pulley system can create a 4:1 to 8:1 mechanical advantage during the upstroke movement of the present invention. Thus, the present invention is a compressor pump system that operates on carbon free electricity to uniformly move a plurality of pistons upwards and downwards to compress gas and pump fluids.

SUMMARY

The present invention is a compressor pump system that utilizes several pistons in a hydraulic or power press manner to compress gas or pump fluids. The present invention seeks to provide users with a device that utilizes mechanical advantage of a pulley on the upstroke and uses a clutch device to utilize the gravitational force on the downstroke. In order to accomplish this the present invention comprises a base that allows the compression process to take place and ensure there is only vertical movement. Further, the weight block ensures the system can utilize gravitational force on the downstroke. Additionally, the pulley system creates a mechanical advantage so that less force is used during the upstroke of the system. Additionally, the plurality of intakes allows for gas or fluids to flow into the present invention. Further, the plurality of outtakes allows for the gas or fluids to flow out of the system once compressed or pumped. Furthermore, the conical tank takes the compressed gas or pumped fluid and further compresses the gas, increasing the pressure without moving parts. Thus, the present invention is a compressor pump system that operates on carbon free electricity to uniformly move a plurality of pistons upwards and downwards to compress gas and pump fluids.

DETAIL DESCRIPTIONS OF THE INVENTION

Figure 1:
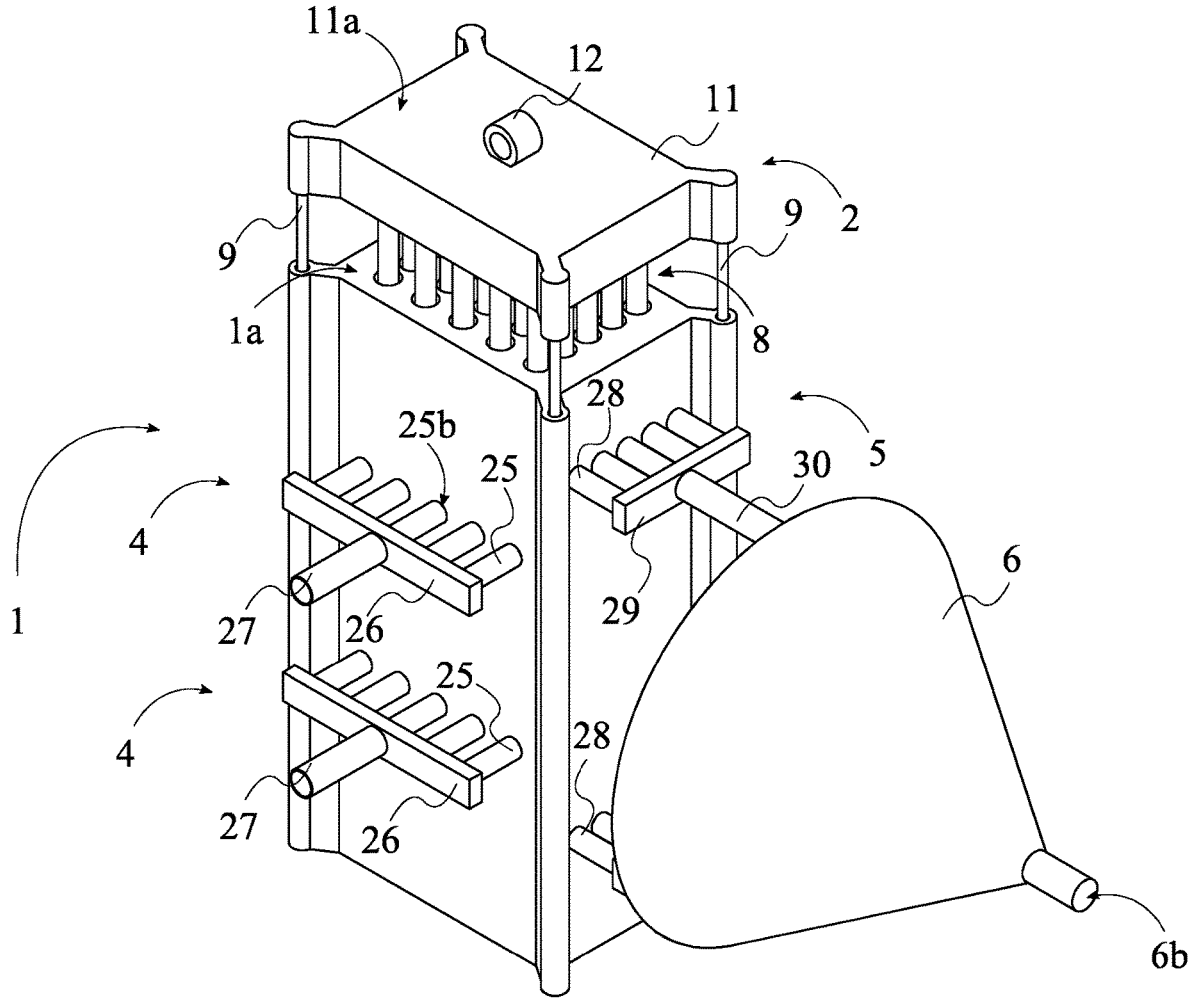
FIG. 1 is a top front left perspective view of the present invention.

All illustrations of the drawings are for the purpose of describing selected versions of the present invention and are not intended to limit the scope of the present invention. In reference to FIG. 1 through FIG. 10, the present invention is a compressor pump system that can compress gas and pump fluids. The present invention seeks to provide users with a device that utilizes a pulley mechanical advantage on the upstroke and uses a clutch device to utilize the gravitational force on the downstroke. In order to accomplish this the present invention comprises a base that allows the compression process to take place and ensure there is only vertical movement. Further, the weight block ensures the system can utilize gravitational force on the downstroke. Additionally, the pulley system creates a mechanical advantage so that less force is used during the upstroke of the system. Additionally, the plurality of intakes allows for gas or fluids to flow into the present invention. Further, the plurality of outtakes allows for the gas or fluids to flow out of the system once compressed or pumped. Furthermore, the conical tank takes the compressed gas or pumped fluid and further compresses the gas, increasing the pressure without moving parts. Thus, the present invention is a compressor pump system that operates on carbon free electricity to uniformly move a plurality of pistons upwards and downwards to compress gas and pump fluids.

The following description is in reference to FIG. 1 through FIG. 10. According to a preferred embodiment, the present invention comprises a base 1, a weight block 2, a pulley system 3, a plurality of intakes 4, a plurality of outtakes 5, and a conical tank 6. In the preferred embodiment, the base 1 comprises a plurality of pressure chambers 7, and the weight block 2 comprises the plurality of pistons 8. Many of these components allow for the user to uniformly move the plurality of pistons 8 to either compress gas or pump fluids. Accordingly, the plurality of pressure chambers 7 is mounted within the base 1, and the weight block 2 is oriented towards a first surface 1*a* of the base 1. Preferably, the plurality of pressure chambers 7 are cavities or chambers in which fluids coming in get compressed or pressurized. To that end, the plurality of pistons 8 is positioned within the plurality of pressure chambers 7, wherein longitudinal movement of the plurality of pistons 8 enables compression of the fluids.

In order for the present invention to work smoothly, the base 1 is situated firmly whereas the weight block 2 is positioned directly above the top side of the base 1. Attached to the top of the weight block 2 is the pulley system 3 that lifts and lowers the weight block 2. In other words, the pulley system 3 is operably coupled with the weight block 2, wherein operating the pulley system 3 enables longitudinal motion of the plurality of pistons 8 along the plurality of pressure chambers 7. Further, as seen in FIG. 1, the plurality of intakes 4 and the plurality of outtakes 5 are laterally mounted onto the base 1. Along the front side of the base 1 is the plurality of intakes 4 where the gas or liquid enters the system. On the left side of the base 1 is the plurality of outtakes 5 where the gas or liquid exits the base 1 towards the conical tank 6. In other words, the plurality of intakes 4 is angularly offset from the plurality of outtakes 5. Furthermore, the plurality of intakes 4 and the plurality of outtakes 5 are in fluid communication with the plurality of pressure chambers 7. More specifically, the plurality of pistons 8 is operably coupled with the plurality of intakes 4, wherein operating the plurality of pistons 8 compresses the fluid coming in from the plurality of intakes 4, and the compressed gas/fluid will be expelled out from the pressure chambers 7 through the plurality of outtakes 5.

In the preferred embodiment, the conical tank 6 is connected to a terminal end of the plurality of outtakes 5 opposite to the base 1, for collecting the pressurized gas coming from the plurality of outtakes 5. In other words, the conical tank 6 is positioned along the left side of the base 1 and connects directly to the plurality of outtakes 5. More specifically, the conical tank 6 is in fluid communication with the plurality of outtakes 5, wherein pressurized fluid coming out of the plurality of outtakes 5 gets transferred to the conical tank 5. The conical tank 6 further enables in compressing the fluid coming out of the plurality of outtakes 5, which is explained further below. Thus, the present invention is a compressor pump system that operates on carbon free electricity to uniformly move a plurality of pistons 8 upwards and downwards to compress gas and pump fluids.

Figure 2:
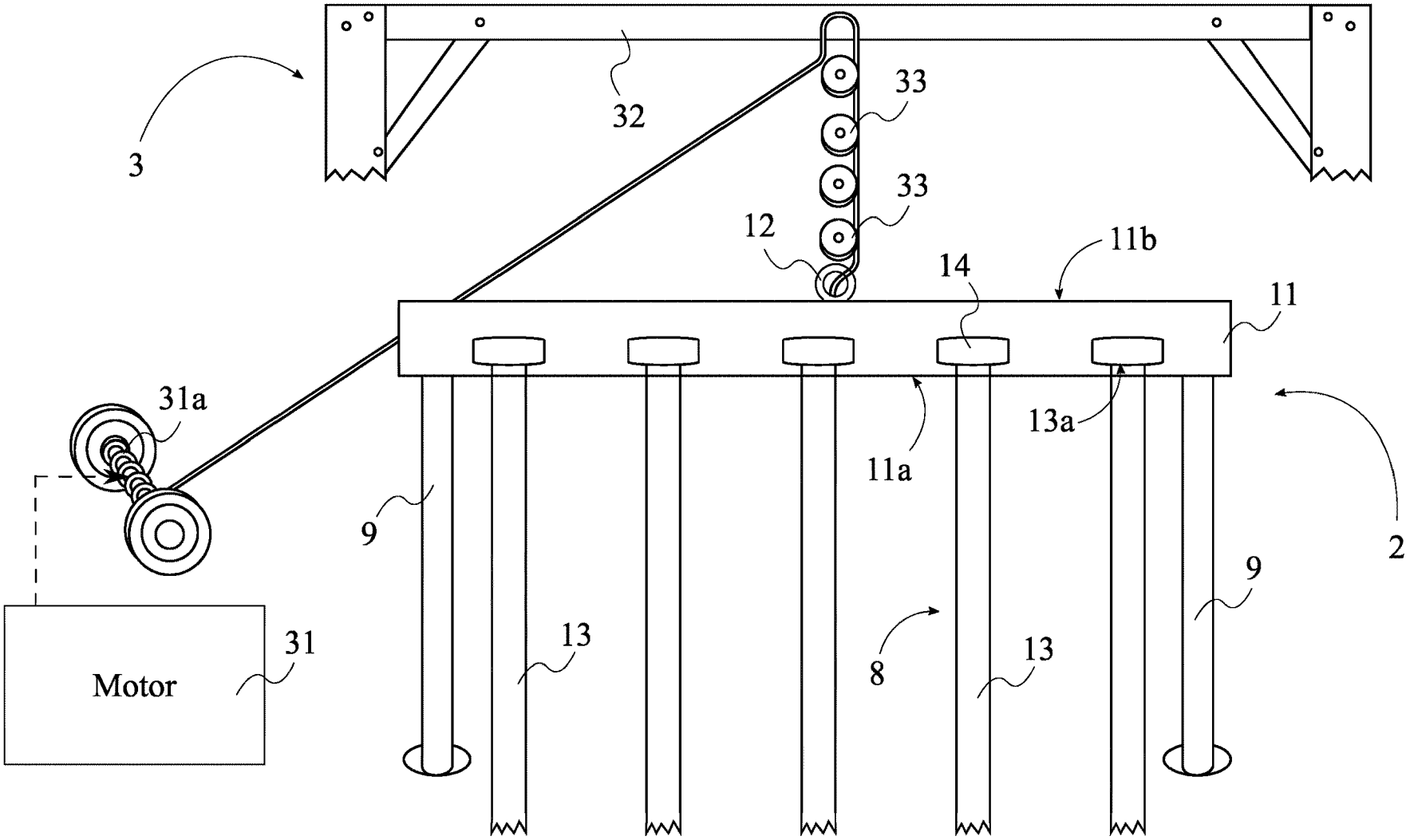
FIG. 2 is a schematic representation of the present invention, wherein a pulley system and a weight block are shown partially.
Figure 8:
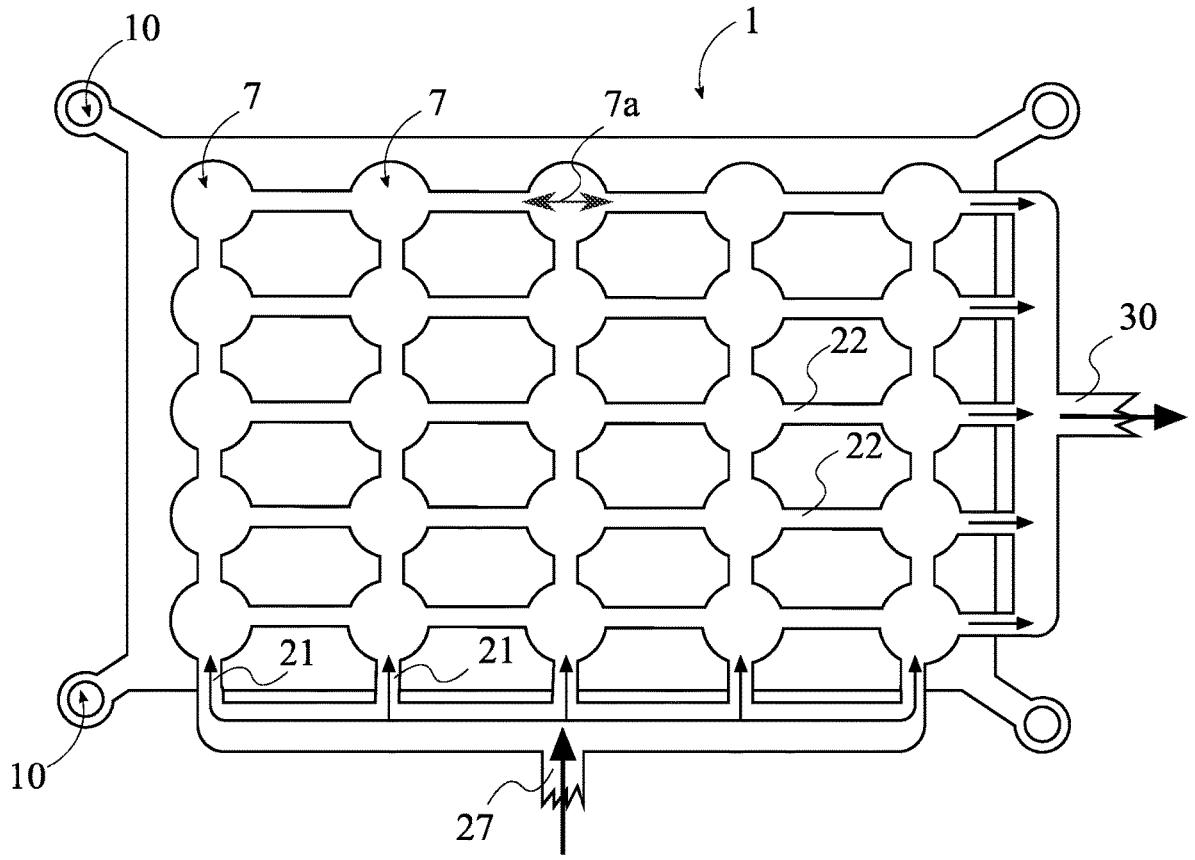
FIG. 8 is a top view of the present invention, wherein only the base, the plurality of intakes and the plurality of outtakes are shown.

A more detailed description of the present invention follows. As seen in FIG. 1 FIG. 2, and FIG. 8, the weight block 2 comprises a plurality of guide bars 9, and the base 1 comprises a plurality of guide bar holes 10. Preferably, the plurality of guide bar holes is laterally and perimetrically mounted onto the base 1, and the plurality of guide bars 9 is threaded through the plurality of guide bar holes 10. The weight block 2 is positioned above the top or first surface 1*a* of the base 1 and stays positioned via the guide bars 9. The weight block 2 is designed with a heavy durable material with a rectangular shape with transverse cross-sectional dimensions similar to the top face of the base 1. Further, the weight block 2 creates a large downward force due to gravity acting on the weight block 2. The plurality of guide bars 9 is positioned along each corner of the weight block 2 and extends downwards with a cylindrical shape that fits into the plurality of guide bar holes 10 of the base 1. This design allows for the weight block 2 to be raised and lowered above the base 1 while limiting any horizontal motion of the weight block 2 to mitigate any damage to the various components and reduce any inefficiencies.

As seen in FIG. 2, the weight block 2 comprises a power bar 11 and a pulley attachment hoop 12. The power bar 11 comprises a second surface 11*a* and a third surface 11*b*, wherein the second surface 11*a* is positioned opposite to the third surface 11*b* across the power bar 11. Preferably, the second surface 11*a* constitutes a lower surface of the power bar 11, and the third surface 11*b* constitutes an upper surface of the power bar 11. As seen in FIG. 2, the plurality of pistons 8 and the plurality of guide bars 9 are mounted on to the second surface 11*a* of the power bar 11, and the pulley attachment hoop 12 is mounted onto the third surface 11*b* of the power bar 11. Preferably, the pulley attachment hoop 12 is a ring-shaped structure mounted on top of the power bar 11, so that the pulley system is terminally connected to the pulley attachment hoop 12. More specifically, a terminal end of the pulley system 3, such as a rope or a string may be threaded through the pulley attachment hoop 12 for enabling upstroke and downstroke of the weight block 2. However, the pulley attachment hoop 12 may comprise any other shape, size, attachment mechanism etc. that are known to one of ordinary skill in the art, as long as the intents of the present invention are fulfilled. Further, the plurality of guide bars 9 is perimetrically mounted onto the second surface 11*b* of the power bar, and the plurality of pistons 8 and the plurality of guide bars 9 extend away from the third surface 11*b* of the power bar 11. As seen in FIG. 2 on the lower side of the power bar 11 is the plurality of pistons 8 with a similar 5 by 5 pattern that matches the position of the plurality of pressure chambers 7.

Figure 9:
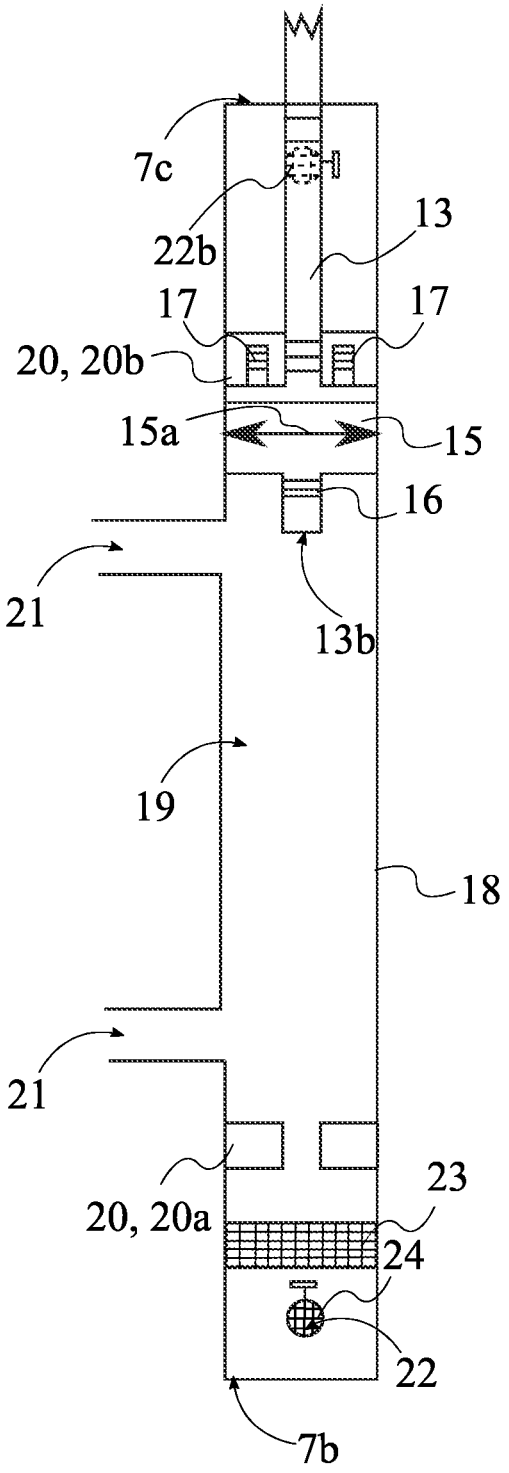
FIG. 9 is a cross sectional view of the pressure chamber in the upstroke mode.
Figure 10:
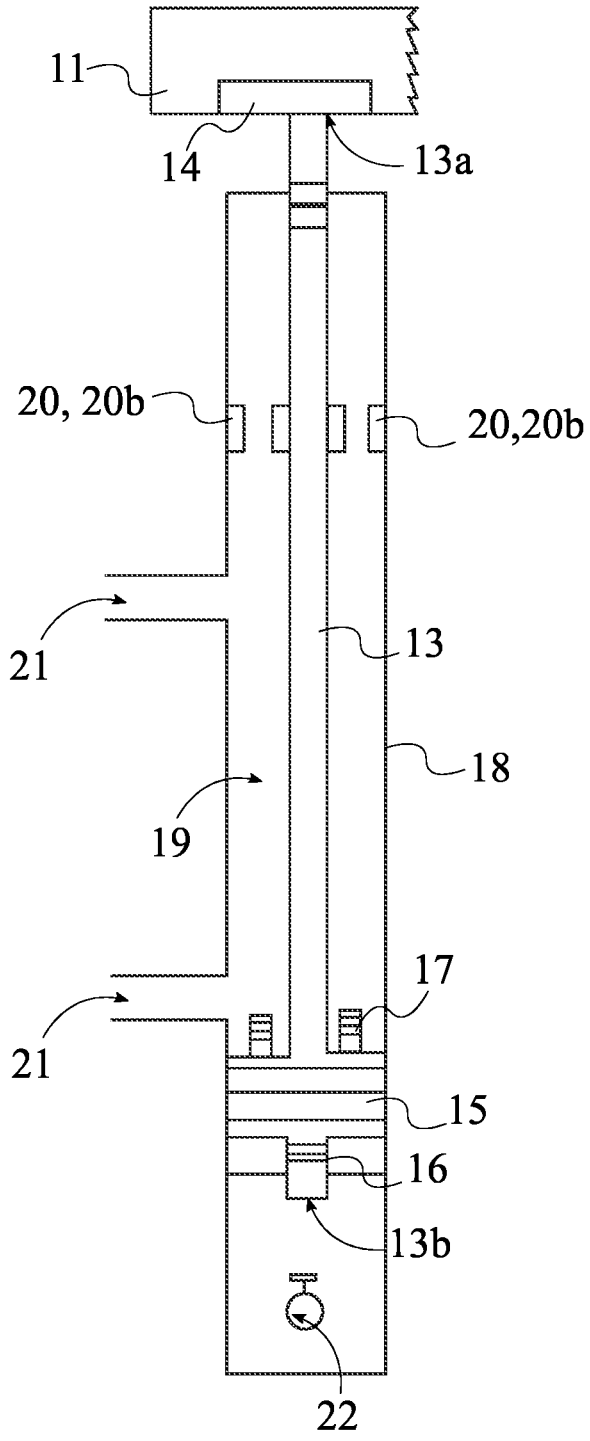
FIG. 10 is a cross sectional view of the pressure chamber in the downstroke mode.

According to the preferred embodiment, each of the plurality of pistons 8 comprises a rod 13, a latching bar 14, a cylindrical base 15, a plurality of sealing rings 16, and a plurality of scaling rods 17. Preferably, the plurality of pistons 8 is designed with a cylindrical shape that extends into the pressure chamber 7 as seen in FIG. 9 and FIG. 10. Accordingly, the rod 13 is the main component that goes in and out of each of the plurality of pressure chambers 7. As seen in FIG. 2, the latching bar 14 is mounted onto a first end 13*a* of the rod 13. The latching bar 14 is the part that connects the piston 8 to the power bar 11. In other words, the latching bar 14 is integrated into the power bar 11 of the weight block 2. Preferably, the first end 13*a* constitutes a top end of the rod 13. Further, as seen in FIG. 9, the cylindrical base 15 is mounted adjacent a second end 13*b* of the rod 13, wherein the second end 13*b* is positioned opposite to the first end 13*a* across the rod 13. The cylindrical base 15 is designed with a diameter that matches the diameter of the plurality of pressure chambers 7 to ensure the gas or liquid within the pressure chamber 7 is properly compressed or moved. In other words, a first diameter 15*a* of the cylindrical base 15 is same as a second diameter 7*a* of the plurality of pressure chambers 7. Further, the plurality of sealing rings 16 is mounted adjacent the cylindrical base 15, opposite to the first end 13*a* of the rod 13, and the plurality of sealing rods 17 is mounted onto the cylindrical base 15 opposite to the second end 13*b* of the rod 13. The plurality of scaling rings 16 and the plurality of scaling rods 17 ensure that the plurality of pressure chambers 7 have a proper seal during both the upstroke and downstroke of the plurality of pistons 8.

In reference to FIG. 9 and FIG. 10, each of the plurality of pressure chambers 7 comprises a base chamber 18, a main cavity 19, a plurality of piston stoppers 20, a plurality of intake holes 21, and a plurality of outtake holes 22. Preferably, the main cavity 19 traverses into base chamber 18, and the base chamber 18 has dimensions that fit within the cavities in the base 1. It should be further noted that, the base 1 can be created in many various shapes and sizes and while the plurality of pressure chambers 7 could be created with various different numbered layouts while still staying within the scope of the present invention. As seen in FIG. 9 and FIG. 10, the plurality of piston stoppers 20 comprises a first piston stopper 20*a* and the second piston stopper 20*b*. The plurality of piston stoppers 20 is mounted within the main cavity 19, in such a way that the first piston stopper 20*a* and the second piston stopper 20*b* delineate the limits for the longitudinal motion of each of the plurality of pistons 8. Preferably, the plurality of scaling rings 16 fits within the opening of the first piston stopper 20*a* during the downstroke pictured in FIG. 10. The plurality of sealing rods 17 fit within the openings of the second piston stopper 20*b* during the upstroke. This arrangement ensures that the plurality of pressure chambers 7 have a proper seal during both the upstroke and downstroke of the plurality of pistons 8. As seen in FIG. 9, the plurality of intake holes 21 is positioned in between the first piston stopper 20*a* and the second piston stopper 20*b*. The plurality of intake holes 21 are the pathways through which the fluid that needs to be pressurized enters into the plurality of pressure chambers 7. Furthermore, the plurality of outtake holes 22 comprises a first outtake hole 22*a* and a second outtake hole 22*b*. In the preferred embodiment, the first outtake hole 22*a* is positioned between the first piston stopper 20*a* and a first end of the pressure chamber 7*b*, and the second outtake hole 22*b* is positioned between the second piston stopper 20*b* and a second end of the pressure chamber 7*c*. The plurality of intake holes 21 allows for the gas or liquid to enter the plurality of pressure chambers 7. Similarly, the plurality of outtake holes 22 allows for the gas or liquid to move through the plurality of pressure chambers 7 except the gas or liquid will be exiting the plurality of pressure chambers 7 and is located above the top piston stopper and below the bottom piston stopper. Additionally, each of the plurality of pressure chambers 7 may comprise a plurality of catalyst screens 23, and a plurality of catalyst cartridge screens 24. As seen in FIG. 9, the plurality of catalyst screens 23 is located between the plurality of piston stoppers 20 and the plurality of outtake holes 22 and comprises a grid like pattern. Further, the plurality of catalyst cartridge screens 24 is laterally mounted onto the plurality of outtake holes 22, covering the plurality of outtake holes 22. The plurality of catalyst screens acts as a filtering screen, and the plurality of catalyst cartridge screens 24 allow the present invention to additionally function as a reactor in an alternate embodiment. More specifically, the alternate embodiment, allows the present invention to function as a chemical reactor when the control of pressure is paramount and will additionally reduce pressure drop during catalyzed reactions.

Positioned along the front side of the base is the plurality of intakes 4 seen in FIG. 1. In the preferred embodiment each of the plurality of intakes 4 comprises a plurality of intake cylinders 25, a first interconnecting bar 26, and a main intake cylinder 27. The plurality of intake cylinders 25 is designed with a sturdy material with cylindrical shaped pipes feeding into the plurality of pressure chambers 7. To that end, a first terminal end 25*a* of each of plurality of intake cylinders 25 is connected to the plurality of intake holes 21. Along the open ends of the plurality of intake cylinders 25 is the main intake cylinder 27 that connects via the first interconnecting bar 26. In other words, a second terminal end 25*b* of each of the plurality of intake cylinders 25 is connected to the first interconnecting bar 26, and the first interconnecting bar 26 is connected to the main intake cylinder 27. This design allows gas and fluids to flow into the plurality of pressure chambers 7 from one or multiple sources. Thus, the plurality of intake cylinders 25 is in fluid communication with the main intake cylinder 27 through the first interconnecting bar 26.

Similar to the plurality of intakes 4, the plurality of outtakes 5 is positioned on the left side of the base 1 above and below the plurality of intakes 4. According to the preferred embodiment, each of the plurality of outtakes 5 comprises a plurality of outtake cylinders 28, a second interconnecting bar 29, and a main outtake cylinder 30. Preferably, a first terminal end 28*a* of each of plurality of outtake cylinders 28 is connected to the plurality of outtake holes 22, and a second terminal end 28*b* of each of the plurality of outtake cylinders 28 is connected to the second interconnecting bar 29. This design allows for the gas or liquid within the plurality of pressure chambers 7 to move into the plurality of outtake cylinders 28. Further, the second interconnecting bar 29 is connected to the main outtake cylinder 30, and the plurality of outtake cylinders 28 is in fluid communication with the main outtake cylinder 30 through the second interconnecting bar 29. Furthermore, the main outtake cylinder 30 is in fluid communication with the conical tank 6. In other words, the plurality of outtake cylinders 28 connects to the main outtake cylinder 30 via the second interconnecting bar 29, wherein the gas or liquid can be pumped towards the conical tank 6.

Figure 3:
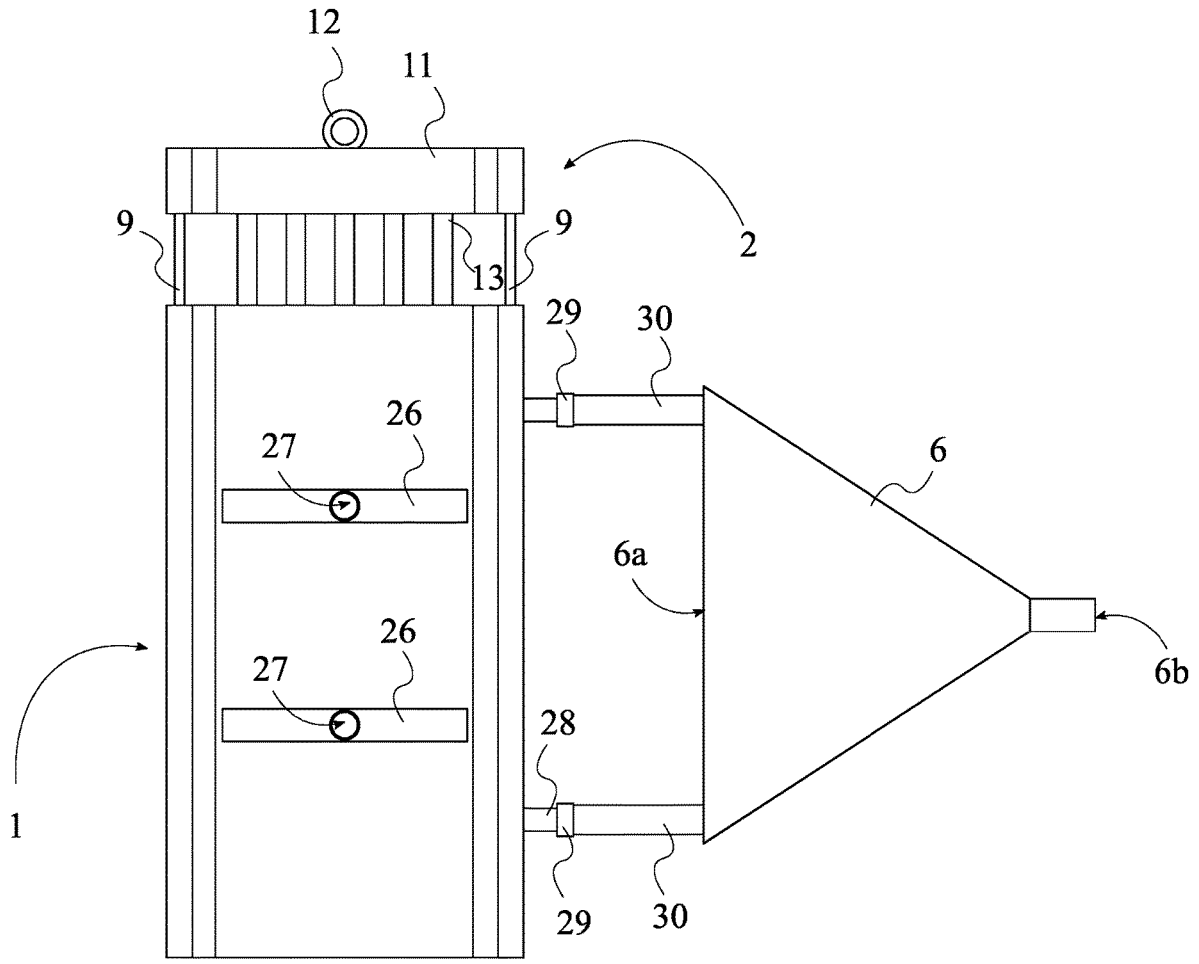
FIG. 3 is a front elevational view of the present invention.
Figure 4:
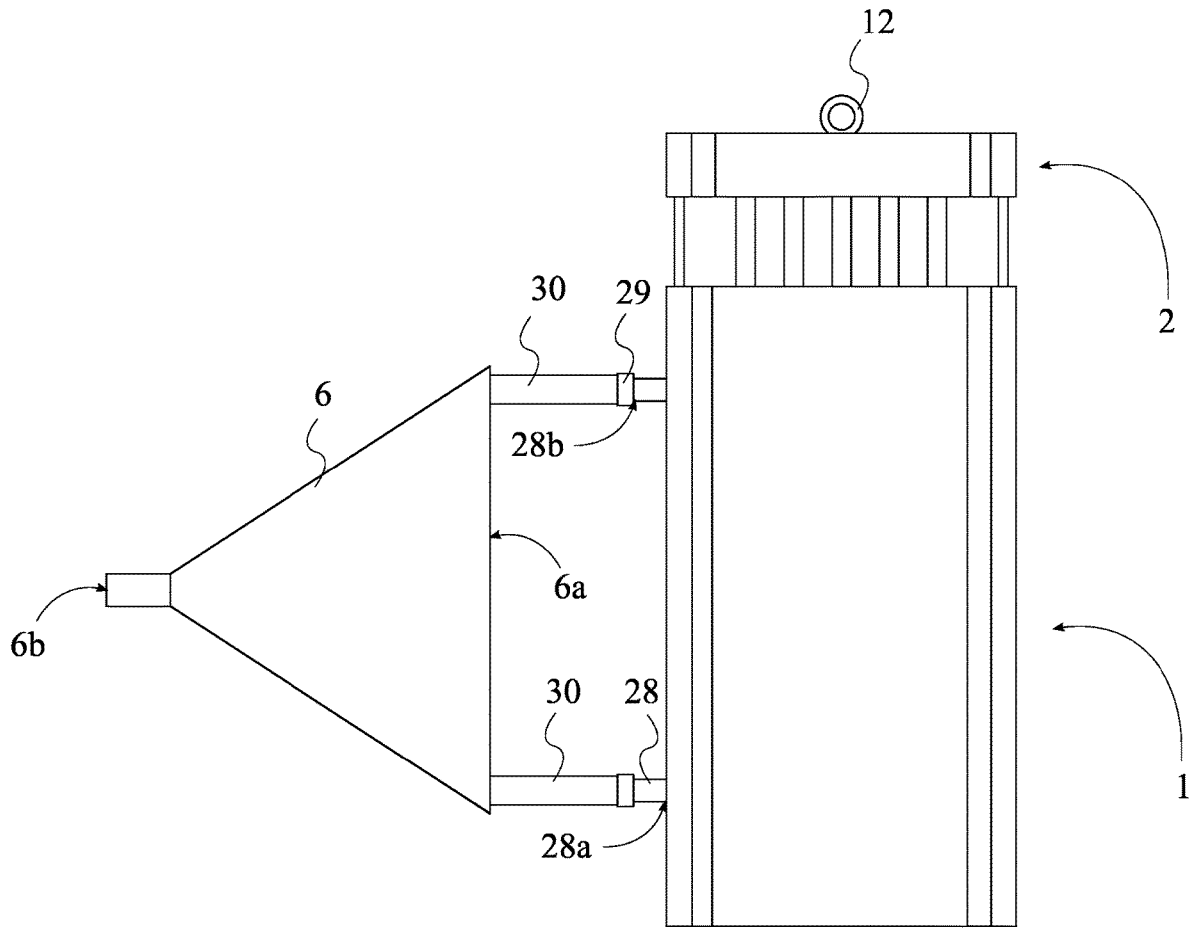
FIG. 4 is a rear elevational view of the present invention.
Figure 5:
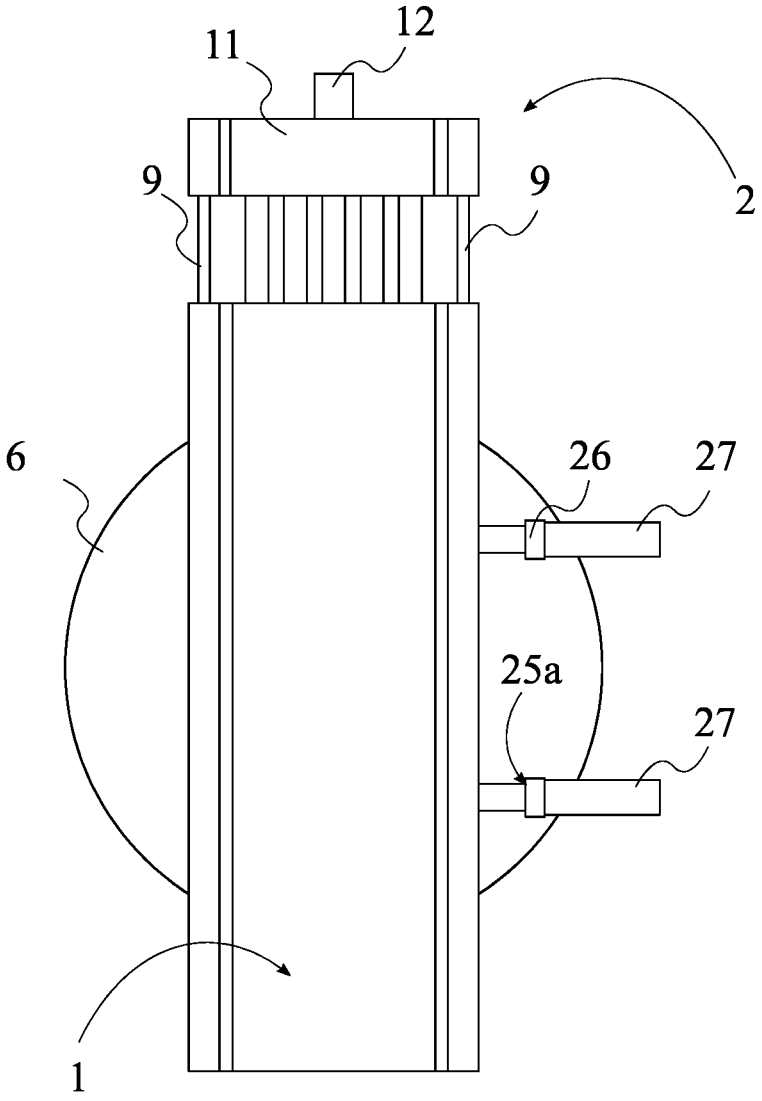
FIG. 5 is a right-side elevational view of the present invention.
Figure 6:
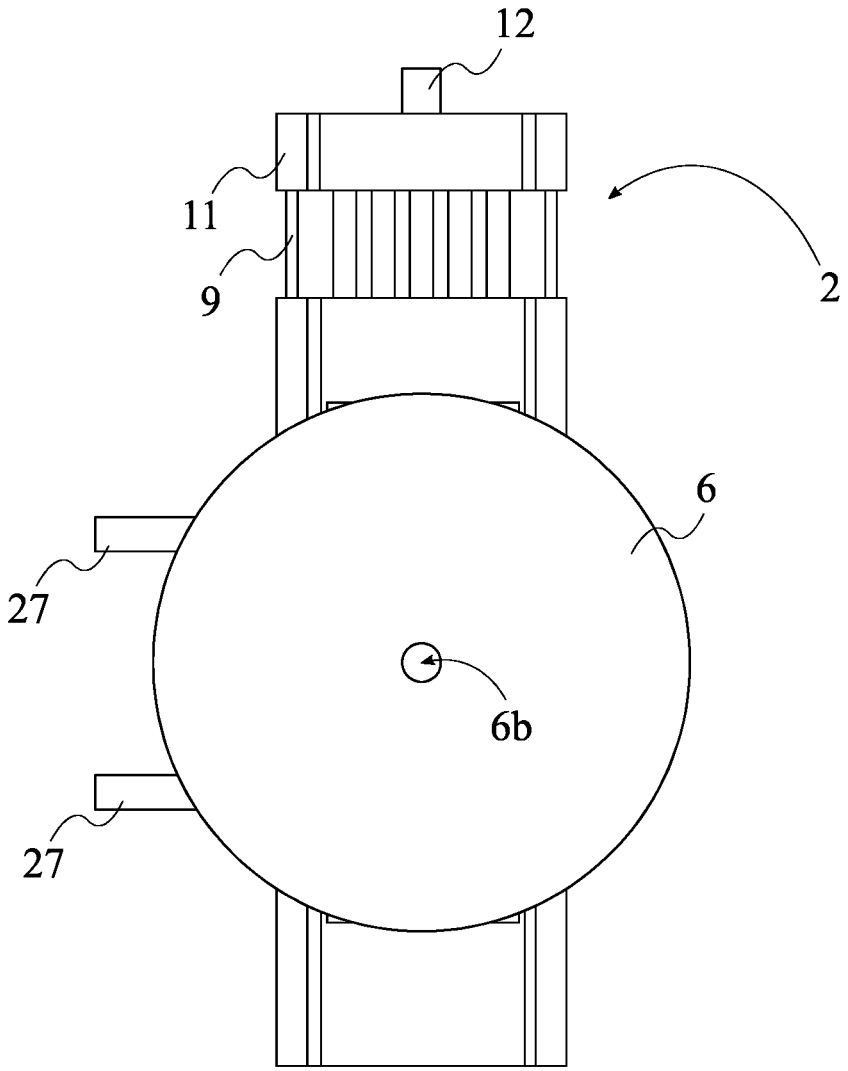
FIG. 6 is a left-side elevational view of the present invention.
Figure 7:
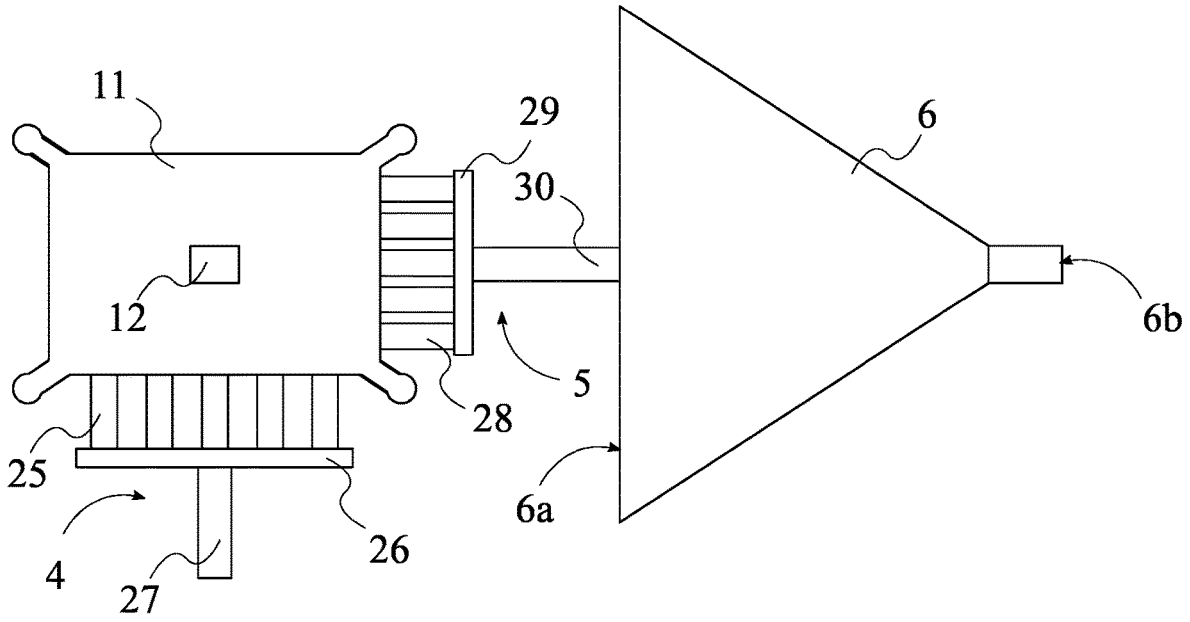
FIG. 7 is a top view of the present invention.

Continuing with the preferred embodiment, the conical tank 6 connects with the plurality of outtakes 5 along the left side of the base seen in FIG. 1, FIG. 3 and FIG. 4. The conical tank 6 is designed with a cone shape with the large base side positioned parallel to the left side of the base 1. To that end, the conical tank 6 comprises a wider inlet region 6*a*, and a narrow outlet region 6*b*. Preferably, the wider inlet region 6*a* is positioned opposite to the narrow outlet region 6*b* across the conical tank 6. Further, the plurality of outtakes 5 is connected to the wider inlet region 6*a*. This design allows for the gas or liquid within the plurality of outtakes 5 to flow into the conical tank 6 to be further pressurized or compressed. At the vertex point of the conical tank 6 is the narrow outlet region 6*b* where the gas or liquid can leave the conical tank 6. This design allows for the gas or liquid to be compressed or pressurized a second time without the need for moving parts, where the pressure can be manipulated by changing the height or radius of the conical tank 6. In other words, fluid coming in through the wider inlet region 6*a* gets compressed as it passes through the narrow outlet region 6*b*. Finally, along the tank outtake hole, there may be a tank valve that allows the user to open and close the narrow outlet region 6*b* or tank outtake hole. This design allows for the entire system to be linked up with other similar systems allowing each to operate simultaneously.

In reference to FIG. 2, the pulley system 3 comprises a motor 31, a support system 32, and a plurality of pulleys 33. To enable the smooth functioning of the present invention, the motor 31 is connected to the pulleys 33. Preferably, the motor 31 converts electrical energy to mechanical energy, to support and enable functioning of the pulley system 3. The motor 31 connects to a carbon free electrical source. During the downstroke of the plurality of pistons 8 the motor 31 utilizes a clutch 31*a* on the winch to allow the addition of gravity to the energy input from the weight block 2, improving the efficiency of the process. It should be noted that the motor 31 may comprise any size, brand, technology etc. that is known to one ordinary skill in the art, as long as the intents of the present invention are not altered. Further, the support system 32 is integrated between the motor 31 and the plurality of pulleys 33, and the plurality of pulleys 33 is positioned between the weight block 2 and the support system 32. The support system 32 is positioned above the weight block 2 to allow the plurality of pulleys 33 to be positioned above the weight block 2 while being attached to the motor 31. The plurality of pulleys 33 is positioned directly above the weight block 2 and below the support system 32 to ensure a mechanical advantage can be applied to lifting the weight block 2 upwards. Further, the plurality of pulleys 33 is terminally connected to the weight block 2 through the pulley attachment hoop 12. As shown in FIG. 2, the plurality of pulleys 33 can be positioned in several ways to achieve a 4:1 to 8:1 force ratio, ensuring the weight block 2 can be lifted without exerting unreasonable amounts of power.

With all the components working in tandem with each other it can be seen that the present invention is a compressor pump system that operates on carbon free electricity to uniformly move a plurality of pistons upwards and downwards to compress gas and pump fluids.

Although the invention has been explained in relation to its preferred embodiment, it is to be understood that many other possible modifications and variations can be made without departing from the spirit and scope of the invention as hereinafter claimed.

What is claimed is:

1. A carbon free compressor pump system, comprising:
- a base;
- a weight block;
- a pulley system;
- a plurality of intakes;
- a plurality of outtakes;
- a conical tank;
- the base comprising a plurality of pressure chambers;
- the weight block comprising a plurality of pistons;
- the plurality of pressure chambers being mounted within the base;
- the weight block being oriented towards a first surface of the base;
- the plurality of pistons being positioned within the plurality of pressure chambers;
- the pulley system being operably coupled with the weight block, wherein operating the pulley system enables longitudinal motion of the plurality of pistons along the plurality of pressure chambers;
- the plurality of intakes and the plurality of outtakes being laterally mounted onto the base;
- the plurality of intakes being angularly offset from the plurality of outtakes;
- the plurality of intakes and the plurality of outtakes being in fluid communication with the plurality of pressure chambers;
- the plurality of pistons being operably coupled with the plurality of intakes, wherein operating the plurality of pistons compresses fluid coming in from the plurality of intakes;
- the conical tank being connected to a terminal end of the plurality of outtakes, opposite to the base; and
- the conical tank being in fluid communication with the plurality of outtakes, wherein pressurized fluid coming out of the plurality of outtakes gets transferred to the conical tank.

2. The carbon free compressor pump system of claim 1, comprising:
- the weight block comprising a plurality of guide bars;
- the base comprising a plurality of guide bar holes;
- the plurality of guide bar holes being laterally and perimetrically mounted onto the base; and
- the plurality of guide bars being threaded through the plurality of guide bar holes.

3. The carbon free compressor pump system of claim 2, comprising:
- the weight block comprising a power bar and a pulley attachment hoop;
- the power bar comprising a second surface and a third surface, wherein the second surface is positioned opposite to the third surface across the power bar;
- the plurality of pistons and the plurality of guide bars being mounted on to the second surface of the power bar;
- the pulley attachment hoop being mounted onto the third surface of the power bar, wherein the pulley system is terminally connected to the pulley attachment hoop;
- the plurality of guide bars being perimetrically mounted onto the second surface of the power bar; and
- the plurality of pistons and the plurality of guide bars extending away from the power bar.

4. The carbon free compressor pump system of claim 1, wherein each of the plurality of pistons comprising:
- a rod;
- a latching bar;
- a cylindrical base;
- a plurality of sealing rings;
- a plurality of scaling rods;
- the latching bar being mounted onto a first end of the rod;
- the latching bar being integrated into a power bar of the weight block;
- the cylindrical base being mounted adjacent a second end of the rod, wherein the second end being positioned opposite to the first end across the rod;
- the plurality of sealing rings being mounted adjacent the cylindrical base, opposite to the first end; and
- the plurality of sealing rods being mounted onto the cylindrical base opposite to the second end.

5. The carbon free compressor pump system of claim 4, wherein a first diameter of the cylindrical base matches a second diameter of the plurality of pressure chambers so the fluid is compressed within the plurality of pressure chambers.

6. The carbon free compressor pump system of claim 1, wherein each of the plurality of pressure chambers comprising:
- a base chamber;
- a main cavity;
- a plurality of piston stoppers;
- a plurality of intake holes;
- a plurality of outtake holes;
- the plurality of outtake holes comprising a first outtake hole and a second outtake hole;
- a plurality of catalyst screens;
- a plurality of catalyst cartridge screens;
- the plurality of piston stoppers comprising a first piston stropper and a second piston stopper;
- the main cavity traversing into the base chamber;
- the plurality of piston stoppers being mounted within the main cavity;
- the first piston stopper and the second piston stopper delineating the limits for the longitudinal motion of each of the plurality of pistons;
- the plurality of intake holes being positioned in between the first piston stopper and the second piston stopper;
- the first outtake hole being positioned between the first piston stopper and a first end of the pressure chamber;

the second outtake hole being positioned between the second piston stopper and a second end of the pressure chamber;

the plurality of catalyst screens being located between the plurality of piston stoppers and the plurality of outtake holes; and the plurality of catalyst cartridge screens being laterally mounted onto the plurality of outtake holes, and covering the plurality of outtake holes.

7. The carbon free compressor pump system of claim 6, each of the plurality of intakes comprising:

a plurality of intake cylinders;

a first interconnecting bar;

a main intake cylinder;

a first terminal end of each of the plurality of intake cylinders being connected to the plurality of intake holes;

a second terminal end of each of the plurality of intake cylinders being connected to the first interconnecting bar;

the first interconnecting bar being connected to the main intake cylinder; and the plurality of intake cylinders being in fluid communication with the main intake cylinder through the first interconnecting bar.

8. The carbon free compressor pump system of claim 6, each of the plurality of outtakes comprising:

a plurality of outtake cylinders;

a second interconnecting bar;

a main outtake cylinder;

a first terminal end of each of the plurality of outtake cylinders being connected to the plurality of outtake holes;

a second terminal end of each of the plurality of outtake cylinders being connected to the second interconnecting bar;

the second interconnecting bar being connected to the main outtake cylinder;

the plurality of outtake cylinders being in fluid communication with the main outtake cylinder through the second interconnecting bar; and the main outtake cylinder being in fluid communication with the conical tank.

9. The carbon free compressor pump system of claim 1, the conical tank comprising:

a wider inlet region;

a narrow outlet region;

the wider inlet region being positioned opposite to the narrow outlet region across the conical tank; and the plurality of outtakes being connected to the wider inlet region.

10. The carbon free compressor pump system of claim 9, wherein the fluid coming in through the wider inlet region gets compressed as it passes through the narrow outlet region.

11. The carbon free compressor pump system of claim 1, the pulley system comprising:

a motor, a support system, and a plurality of pulleys;

the motor being connected to the plurality of pulleys;

the support system being integrated between the motor and the plurality of pulleys; and the plurality of pulleys being positioned between the weight block and the support system.

12. A carbon free compressor pump system, comprising:

a base;

a weight block;

a pulley system;

a plurality of intakes;

a plurality of outtakes;

a conical tank;

the base comprising a plurality of pressure chambers, and a plurality of guide bar holes;

the weight block comprising a plurality of pistons, a plurality of guide bars;

the plurality of pressure chambers being mounted within the base;

the weight block being oriented towards a first surface of the base;

the plurality of pistons being positioned within the plurality of pressure chambers;

the plurality of guide bar holes being laterally and perimetrically mounted onto the base;

the plurality of guide bars being threaded through the plurality of guide bar holes;

the pulley system being operably coupled with the weight block, wherein operating the pulley system enables longitudinal motion of the plurality of pistons along the plurality of pressure chambers;

the plurality of intakes and the plurality of outtakes being laterally mounted onto the base;

the plurality of intakes being angularly offset from the plurality of outtakes;

the plurality of intakes and the plurality of outtakes being in fluid communication with the plurality of pressure chambers;

the plurality of pistons being operably coupled with the plurality of intakes, wherein operating the plurality of pistons compresses fluid coming in from the plurality of intakes;

the conical tank being connected to a terminal end of the plurality of outtakes, opposite to the base; and the conical tank being in fluid communication with the plurality of outtakes, wherein pressurized fluid coming out of the plurality of outtakes gets transferred to the conical tank.

13. The carbon free compressor pump system of claim 12, comprising:

the weight block comprising a power bar and a pulley attachment hoop;

the power bar comprising a second surface and a third surface, wherein the second surface is positioned opposite to the third surface across the power bar;

the plurality of pistons and the plurality of guide bars being mounted on to the second surface of the power bar;

the pulley attachment hoop being mounted onto the third surface of the power bar, wherein the pulley system is terminally connected to the pulley attachment hoop;

the plurality of guide bars being perimetrically mounted onto the second surface of the power bar; and the plurality of pistons and the plurality of guide bars extending away from the power bar.

14. The carbon free compressor pump system of claim 12, wherein each of the plurality of pistons comprising:

a rod;

a latching bar;

a cylindrical base;

a plurality of sealing rings;

a plurality of sealing rods;

the latching bar being mounted onto a first end of the rod;

the latching bar being integrated into a power bar of the weight block;

the cylindrical base being mounted adjacent a second end of the rod, wherein the second end being positioned opposite to the first end across the rod;

the plurality of sealing rings being mounted adjacent the cylindrical base, opposite to the first end; and the plurality of sealing rods being mounted onto the cylindrical base opposite to the second end.

15. The carbon free compressor pump system of claim 12, wherein each of the plurality of pressure chambers comprising:

a base chamber;

a main cavity;

a plurality of piston stoppers;

a plurality of intake holes;

a plurality of outtake holes;

the plurality of outtake holes comprising a first outtake hole and a second outtake hole;

a plurality of catalyst screens;

a plurality of catalyst cartridge screens;

the plurality of piston stoppers comprising a first piston stropper and a second piston stopper;

the main cavity traversing into the base chamber;

the plurality of piston stoppers being mounted within the main cavity;

the first piston stopper and the second piston stopper delineating the limits for the longitudinal motion of each of the plurality of pistons;

the plurality of intake holes being positioned in between the first piston stopper and the second piston stopper;

the first outtake hole being positioned between the first piston stopper and a first end of the pressure chamber;

the second outtake hole being positioned between the second piston stopper and a second end of the pressure chamber;

the plurality of catalyst screens being located between the plurality of piston stoppers and the plurality of outtake holes; and the plurality of catalyst cartridge screens being laterally mounted onto the plurality of outtake holes, and covering the plurality of outtake holes.

16. The carbon free compressor pump system of claim 15, each of the plurality of intakes comprising:

a plurality of intake cylinders;

a first interconnecting bar;

a main intake cylinder;

a first terminal end of each of the plurality of intake cylinders being connected to the plurality of intake holes;

a second terminal end of each of the plurality of intake cylinders being connected to the first interconnecting bar;

the first interconnecting bar being connected to the main intake cylinder; and the plurality of intake cylinders being in fluid communication with the main intake cylinder through the first interconnecting bar.

17. The carbon free compressor pump system of claim 15, each of the plurality of outtakes comprising:

a plurality of outtake cylinders;

a second interconnecting bar;

a main outtake cylinder;

a first terminal end of each of the plurality of outtake cylinders being connected to the plurality of outtake holes;

a second terminal end of each of the plurality of outtake cylinders being connected to the second interconnecting bar;

the second interconnecting bar being connected to the main outtake cylinder;

the plurality of outtake cylinders being in fluid communication with the main outtake cylinder through the second interconnecting bar; and the main outtake cylinder being in fluid communication with the conical tank.

18. The carbon free compressor pump system of claim 12, the conical tank comprising:

a wider inlet region;

a narrow outlet region;

the wider inlet region being positioned opposite to the narrow outlet region across the conical tank; and the plurality of outtakes being connected to the wider inlet region.

19. The carbon free compressor pump system of claim 12, the pulley system comprising:

a motor, a support system, and a plurality of pulleys;

the motor being connected to the plurality of pulleys;

the support system being integrated between the motor and the plurality of pulleys; and the plurality of pulleys being positioned between the weight block and the support system.

* * * * *